US010796615B2

(12) United States Patent
Xu et al.

(10) Patent No.: US 10,796,615 B2
(45) Date of Patent: Oct. 6, 2020

(54) CIRCUIT AND METHOD FOR REGULATING POWER SUPPLYING, AND TEST SYSTEM

(71) Applicants: BOE TECHNOLOGY GROUP CO., LTD., Beijing (CN); Chongqing BOE Optoelectronics Technology Co., Ltd., Chongqing (CN)

(72) Inventors: Bo Xu, Beijing (CN); Shuai Hou, Beijing (CN); Xinghong Liu, Beijing (CN); Tonghui Li, Beijing (CN); Can Shen, Beijing (CN); Xiaobo Yu, Beijing (CN); Chieh shun Lin, Beijing (CN); Haiyan Li, Beijing (CN)

(73) Assignees: BOE TECHNOLOGY GROUP CO., LTD., Beijing (CN); Chongqing BOE Optoelectronics Technology Co., Ltd., Chongqing (CN)

( * ) Notice: Subject to any disclaimer, the term of this patent is extended or adjusted under 35 U.S.C. 154(b) by 45 days.

(21) Appl. No.: 16/192,334

(22) Filed: Nov. 15, 2018

(65) Prior Publication Data

US 2019/0213934 A1 Jul. 11, 2019

(30) Foreign Application Priority Data

Jan. 10, 2018 (CN) ..... 2018 1 0022259

(51) Int. Cl.

| | |
|---|---|
| ***G09G 3/00*** | (2006.01) |
| ***G05F 1/56*** | (2006.01) |
| ***G09G 3/20*** | (2006.01) |

(52) U.S. Cl.

CPC ..... *G09G 3/006* (2013.01); *G05F 1/56* (2013.01); *G09G 3/20* (2013.01); (Continued)

(58) Field of Classification Search

CPC .... G05F 1/56; G09G 3/006; G09G 2330/021; G09G 2330/026

See application file for complete search history.

(56) References Cited

U.S. PATENT DOCUMENTS

2006/0192544 A1* 8/2006 Huang ..... G05F 1/56 323/367

2008/0246751 A1 10/2008 Lee (Continued)

FOREIGN PATENT DOCUMENTS

CN 101373302 A 2/2009

CN 104035474 A 9/2014

(Continued)

OTHER PUBLICATIONS

Chinese Office Action dated Aug. 4, 2020, from application No. 201810022259.4.

*Primary Examiner* — Abbas I Abdulselam

(74) *Attorney, Agent, or Firm* — Foley & Lardner LLP

(57) ABSTRACT

The present disclosure relates to a circuit for regulating power supplying, a method for regulating power supplying and a test system. The circuit for regulating power supplying includes a switch circuit connected to a first power terminal and an output terminal. The switch circuit is configured to control whether a power supply is turned on or off. The circuit includes a turn-off rate control circuit connected to the first power terminal, a second power terminal and the switch circuit. The turn-off rate control circuit is configured to control a turn-off rate of the switch circuit.

14 Claims, 9 Drawing Sheets

(52) U.S. Cl.
CPC . *G09G 2320/0257* (2013.01); *G09G 2330/02* (2013.01); *G09G 2330/021* (2013.01); *G09G 2330/026* (2013.01); *G09G 2330/027* (2013.01); *G09G 2330/12* (2013.01)

(56) References Cited

U.S. PATENT DOCUMENTS

| | | | | |
|---|---|---|---|---|
| 2013/0057481 | A1* | 3/2013 | Lee | G06F 3/0412 345/173 |
| 2017/0243558 | A1* | 8/2017 | Yamamoto | G09G 3/3677 |

FOREIGN PATENT DOCUMENTS

| | | | |
|---|---|---|---|
| CN | 105679218 | A | 6/2016 |
| CN | 105976773 | A | 9/2016 |
| CN | 107168445 | A | 9/2017 |
| JP | 2005-017217 | A | 1/2005 |

* cited by examiner

CIRCUIT AND METHOD FOR REGULATING POWER SUPPLYING, AND TEST SYSTEM

TECHNICAL FIELD

The present disclosure relates to the field of display, and particularly to a circuit and method for regulating power supplying, and a test system.

BACKGROUND

In the field of display, testing and evaluating the performance of display devices is an important way to ensure product quality.

In the test and evaluation of a liquid crystal display module (LCD Module, LCM), it is necessary to perform a power-on and power-down test on the liquid crystal display module, especially in the evaluation of a display screen of a notebook computer, power-on and power-off of a power supply is an important item in the evaluation of the liquid crystal display module in the notebook computer.

It should be noted that information disclosed in above background is only for enhancing the understanding of the background of the present disclosure, and thus may include information that does not constitute prior art known to those skilled in the art.

SUMMARY

According to a first aspect of the present disclosure, there is provided a circuit for regulating power supplying. The circuit includes a switch circuit connected to a first power terminal and an output terminal. The switch circuit is configured to control whether a power supply is turned on or off. The circuit includes a turn-off rate control circuit connected to the first power terminal, a second power terminal and the switch circuit. The turn-off rate control circuit is configured to control a turn-off rate of the switch circuit.

In an exemplary arrangement of the present disclosure, the turn-off rate control circuit further includes a first turn-off rate control sub-circuit connected to the switch circuit, the first power terminal and the second power terminal. The first turn-off rate control sub-circuit is configured to control the turn-off rate of the switch circuit. The turn-off rate control circuit further includes a second turn-off rate control sub-circuit connected to the first turn-off rate control sub-circuit and the second power terminal. The second turn-off rate control sub-circuit is configured to provide a turn-on voltage to the first turn-off rate control sub-circuit.

In an exemplary arrangement of the present disclosure, the circuit for regulating power supplying further includes a turn-on rate control circuit connected to the switch circuit and the turn-off rate control circuit, and configured to control a turn-on rate of the switch circuit.

In an exemplary arrangement of the present disclosure, the turn-on rate control circuit further includes a first resistor. A first terminal of the first resistor is connected to the switch circuit, and a second terminal of the first resistor is connected to the turn-off rate control circuit.

In an exemplary arrangement of the present disclosure, the switch circuit further includes a switching transistor. A first terminal of the switching transistor is connected to the first power terminal, a second terminal of the switching transistor is connected to the output terminal, and a control terminal of the switching transistor is connected to the turn-off rate control circuit.

In an exemplary arrangement of the present disclosure, the first turn-off rate control sub-circuit further includes a triode. A first terminal of the triode is connected to the switch circuit, a second terminal of the triode is connected to the second power terminal, and a control terminal of the triode is connected to the first power terminal.

The second turn-off rate control sub-circuit further includes a second resistor and a third resistor. A first terminal of the second resistor is connected to the control terminal of the triode, and a second terminal of the second resistor is connected to the second power terminal. A first terminal of the third resistor is connected to the first power terminal, and a second terminal of the third resistor is connected to the first terminal of the second resistor.

In an exemplary arrangement of the present disclosure, the circuit for regulating power supplying further includes a voltage supplying circuit connected to the first power terminal and the second power terminal. The voltage supplying circuit is configured to store a voltage provided by the first power terminal.

In an exemplary arrangement of the present disclosure, the voltage supplying circuit includes a first capacitor and a second capacitor. A first terminal of the first capacitor and a first terminal of the second capacitor are connected to the first power terminal, and a second terminal of the first capacitor and a second terminal of the second capacitor are connected to the second power terminal.

In an exemplary arrangement of the present disclosure, the circuit for regulating power supplying further includes a turn-on rate control circuit and a voltage supplying circuit. The turn-off rate control circuit includes a first turn-off rate control sub-circuit and a second turn-off rate control sub-circuit. The switch circuit includes a switching transistor. The turn-on rate control circuit includes a first resistor. The first turn-off rate control sub-circuit includes a triode. The second turn-off rate control sub-circuit includes a second resistor. The voltage supplying circuit includes a first capacitor and a second capacitor. A first terminal of the switching transistor is connected to the first power terminal, a second terminal of the switching transistor is connected to the output terminal, and a control terminal of the switching transistor is connected to a first terminal of the first resistor. A first terminal of the triode is connected to a second terminal of the first resistor, a second terminal of the triode is connected to the second power terminal, and a control terminal of the triode is connected to a second terminal of the third resistor. A first terminal of the second resistor is connected to the control terminal of the triode, and a second terminal of the second resistor is connected to the second power terminal. A first terminal of the first capacitor and a first terminal of the second capacitor are connected to the first power terminal, and a second terminal of the first capacitor and a second terminal of the second capacitor are connected to the second power terminal. A first terminal of the third resistor is connected to the first power terminal, and the second terminal of the third resistor is connected to the first terminal of the second resistor.

In an exemplary arrangement of the present disclosure, the circuit for regulating power supplying further includes a fourth resistor, a third capacitor, a fourth capacitor and a fifth capacitor. A first terminal of the fourth resistor is connected to the first terminal of the switching transistor, and a second terminal of the fourth resistor is connected to the control terminal of the switching transistor. A first terminal of the third capacitor is connected to the control terminal of the triode, and a second terminal of the third capacitor is connected to the second power terminal. A first terminal of the fourth capacitor is connected to the first power terminal, and a second terminal of the fourth capacitor is connected to the control terminal of the switching transistor. A first terminal of the fifth capacitor is connected to the second terminal of the switching transistor, and a second terminal of the fifth capacitor is connected to the second power terminal.

According to a second aspect of the present disclosure, there is provided a method for regulating power supplying, applied to the circuit for regulating power supplying described above. The method includes controlling a turn-on rate of the switch circuit by regulating a turn-on rate control circuit when a signal is provided by the first power terminal. The method includes controlling a turn-off rate of the switch circuit by regulating the turn-off rate control circuit when the signal is disconnected by the first power terminal.

In an exemplary arrangement of the present disclosure, controlling a turn-on rate of the switch circuit by regulating a turn-on rate control circuit when a signal is provided by the first power terminal includes either increasing a resistance value of the first resistor to reduce the turn-on rate of the switch circuit, or reducing the resistance value of the first resistor to increase the turn-on rate of the switch circuit.

In an exemplary arrangement of the present disclosure, controlling a turn-off rate of the switch circuit by regulating the turn-off rate control circuit when the signal is disconnected by the first power terminal includes either increasing a resistance value of the second turn-off rate control sub-circuit to increase the turn-off rate of the switch circuit, or reducing the resistance value of the second turn-off rate control sub-circuit to reduce the turn-off rate of the switch circuit.

According to a third aspect of the present disclosure, there is provided a test system. The test system includes a circuit for regulating power supplying configured to control a power-on and power-down rate of a display circuit. The test system includes a signal transmission circuit configured to transmit a signal to the display circuit. The circuit for regulating power supplying is the circuit for regulating power supplying described above.

It can be known from above technical solutions that, the circuit for regulating power supplying, method for regulating power supplying and test system in the exemplary arrangements of the present disclosure have at least following advantages and positive effects:

Through the circuit for regulating power supplying in the present disclosure, the power-on or power-down rate can be regulated when the power supply is turned on or off; and the power-on and power-down state of the power supply when a real system is turned on and off can be simulated for the evaluation of the display circuit, so as to discover potential problems and solve the problems, and improve the performance of the display device.

It is to be understood that both the foregoing general description and the following detailed description are exemplary and explanatory only and are not restrictive of the present disclosure, as claimed.

BRIEF DESCRIPTION OF THE DRAWINGS

The accompanying drawings, which are incorporated in and constitute a part of this specification, illustrate arrangements consistent with the present disclosure and, together with the description, serve to explain the principles of the present disclosure. Apparently, the arrangements described are only a part and not all of the arrangements of the present disclosure. All other arrangements derived by those skilled in the art from the arrangements of the present disclosure without making any inventive effort fall within the scope of the present disclosure.

DETAILED DESCRIPTION

Figure 1:
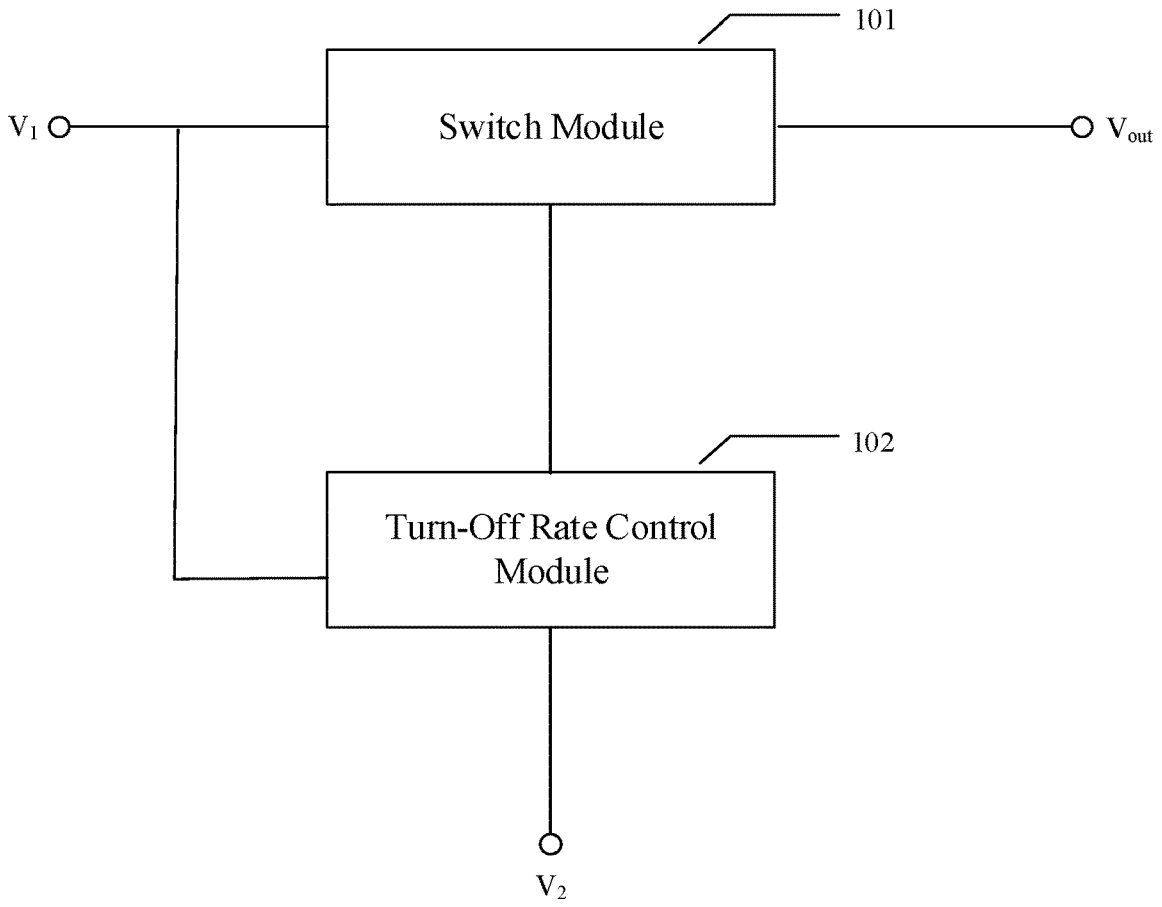
FIG. 1 shows a structure diagram of a circuit for regulating power supplying according to an exemplary arrangement of the present disclosure.

Exemplary arrangements will now be described more fully with reference to the accompanying drawings. However, the exemplary arrangements can be implemented in various forms and should not be construed as being limited to the examples set forth herein. Instead, the provision of these arrangements will make this disclosure more comprehensive and complete, and will fully convey the concept of the exemplary arrangements to those skilled in the art. The described features, structures, or characteristics may be combined in one or more arrangements in any suitable manner. In the following description, numerous specific details are provided to give a full understanding of the arrangements of the present disclosure. However, those skilled in the art will realize that one or more of the specific details may be omitted or other methods, components, devices, steps, etc. can be employed when practicing the technical solution of the present disclosure. In other cases, well-known technical solutions are not shown or described in detail in order to avoid obscuring aspects of the present disclosure.

The terms "a", "an", "the" and "said" are used in this specification to indicate the existence of one or more elements/components/etc.; the terms "including" and "having" are used to denote the meaning of open inclusion and mean that there may be additional elements/components/etc. in addition to the listed elements/components/etc.; and the terms "first", "second" and the like are used only as marks and are not intended to limit the number of objects.

In addition, the accompanying drawings are only schematic illustrations of the present disclosure, and are not necessarily drawn to scale. Same reference signs in the accompanying drawings denote same or similar parts, and the repeated description thereof will be omitted. Some of the block diagrams shown in the accompanying drawings are functional entities and do not necessarily have to correspond to physically or logically independent entities.

In general, existing test systems can realize the power-on and power-down test of the power supply during an evaluation process, but a speed of the power-on and power-down of the power supply cannot be controlled, thus resulting in that an actual power-on and power-down situation of a notebook computer system cannot be truly simulated during the evaluation process of the LCM, and thus potential problems cannot be discovered. For example, when the power supply of the LCM supplied by the notebook computer system is powered down, a gate driver (G-IC) cannot work properly to turn off a thin film transistor (TFT) due to a fast power-down rate, thus resulting in a residual image caused by residual charge.

Aiming at least the above problem, arrangements of the present disclosure provide a circuit for regulating power supplying, a method for regulating power supplying and a test system. Through the circuit for regulating power supplying, a power-on and power-down rate of a power supply can be regulated, and a power-on and power-down state of the power supply when a real system is turned on and off can be simulated for the test system, so as to discover potential problems and solve the problems, and improve the performance of the display device.

In an exemplary arrangement of the present disclosure, a circuit for regulating power supplying is firstly provided. As shown in FIG. 1, the circuit for regulating power supplying 100 includes a switch circuit 101 and a turn-off rate control circuit 102. One terminal of the switch circuit 101 is connected to a first power terminal $V_1$, and the other terminal of the switch circuit 101 is directly connected to an output terminal of the circuit for regulating power supplying, and the switch circuit 101 is configured to enable on and off of the power supplying by the the circuit for regulating power supplying. A first terminal of the turn-off rate control circuit 102 is indirectly connected to the first power terminal $V_1$, a second terminal of the turn-off rate control circuit 102 is directly connected to a second power terminal $V_2$, a third terminal of the turn-off rate control circuit 102 is indirectly connected to the switch circuit 101, and the turn-off rate control circuit 102 is configured to control a turn-off rate of the switch circuit 101.

The circuit for regulating power supplying in the present disclosure can realize the control of the turn-off rate of the switch circuit through the turn-off rate control circuit when an external power supply is turned off, thus implementing the control of the power-down rate. For example, when testing and evaluating the display circuit, the power-down rate is controlled, which enables technical staffs to discover potential problems in time and solve the problems, thus ensuring and improving the performance of a display device.

In the exemplary arrangement of the present disclosure, a potential of the first power terminal $V_1$ is higher than that of the second power terminal $V_2$. A power supply for providing signals to the first power terminal $V_1$ and the second power terminal $V_2$ may be a switching power supply, a direct current stabilized power supply or an alternating current stabilized power supply, or may be other power supplies commonly used in the field. Further, the second power terminal $V_2$ is preferably grounded.

Figure 2:
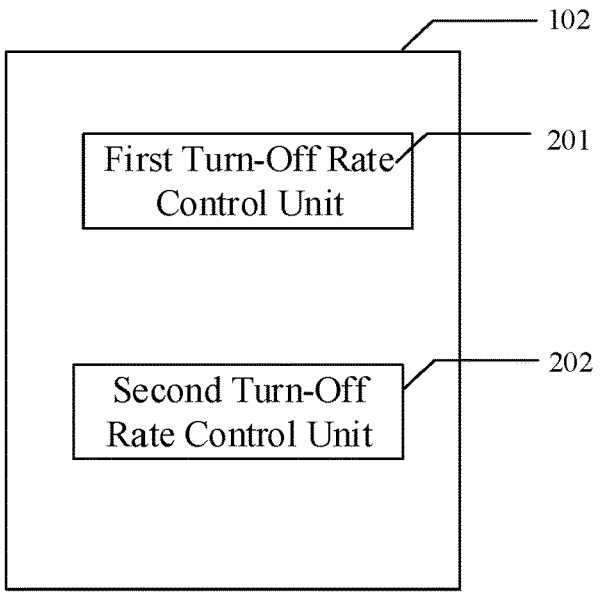
FIG. 2 shows a structure diagram of a turn-off rate control circuit according to an exemplary arrangement of the present disclosure.
Figure 3:
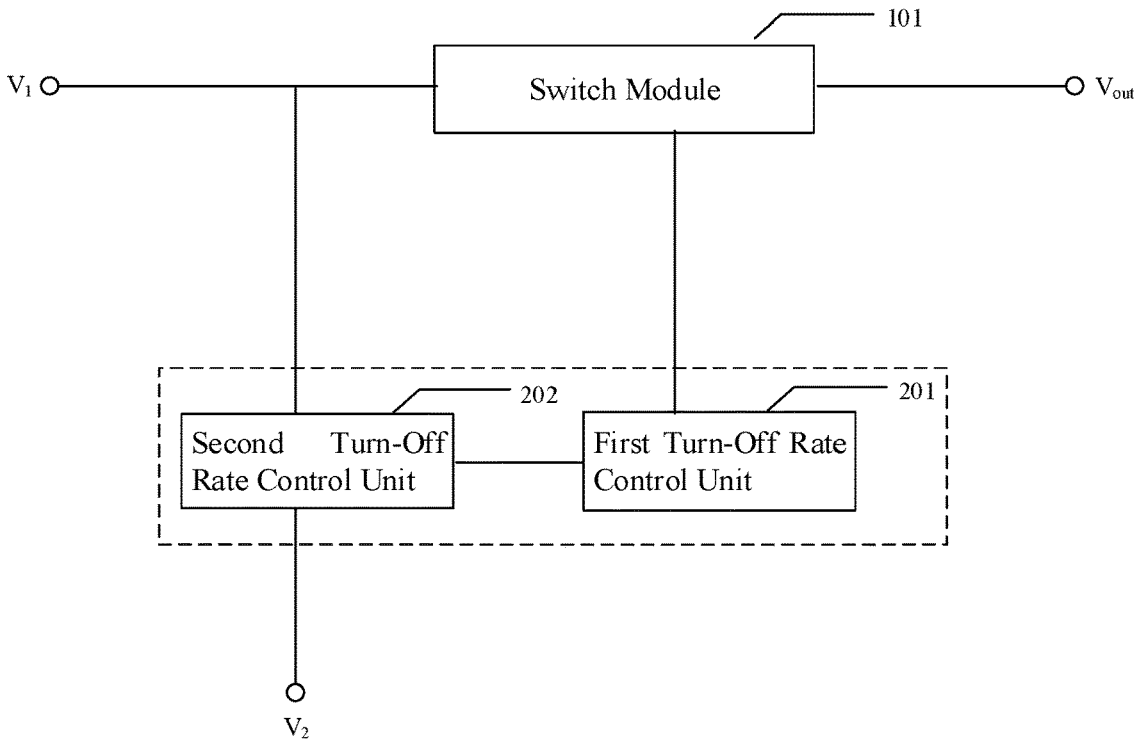
FIG. 3 shows a structure diagram of a circuit for regulating power supplying according to an exemplary arrangement of the present disclosure.

FIG. 2 shows a structure of the turn-off rate control circuit. The turn-off rate control circuit 102 includes a first turn-off rate control sub-circuit 201 and a second turn-off rate control sub-circuit 202. FIG. 3 shows a structure diagram of a circuit for regulating power supplying. As shown in FIG. 3, the first turn-off rate control sub-circuit 201 is directly connected to the switch circuit 101 and the second power terminal $V_2$, and is indirectly connected to the first power terminal $V_1$. The second turn-off rate control sub-circuit 202 is directly connected to the first turn-off rate control sub-circuit 201 and the second power terminal $V_2$. The first turn-off rate control sub-circuit 201 is configured to control a turn-off rate of the switch circuit 101, and the second turn-off rate control sub-circuit 202 is configured to regulate a voltage applied to the first turn-off rate control sub-circuit 201. When a signal of the first power terminal $V_1$ is turned off, the voltage applied to the first turn-off rate control sub-circuit 201 can be regulated by regulating the second turn-off rate control sub-circuit 202, so as to control the turn-off rate of the first turn-off rate control sub-circuit 201, and further to control the turn-off rate of the switch circuit 101, and thus the regulation of the power-down rate can be realized.

Figure 4:
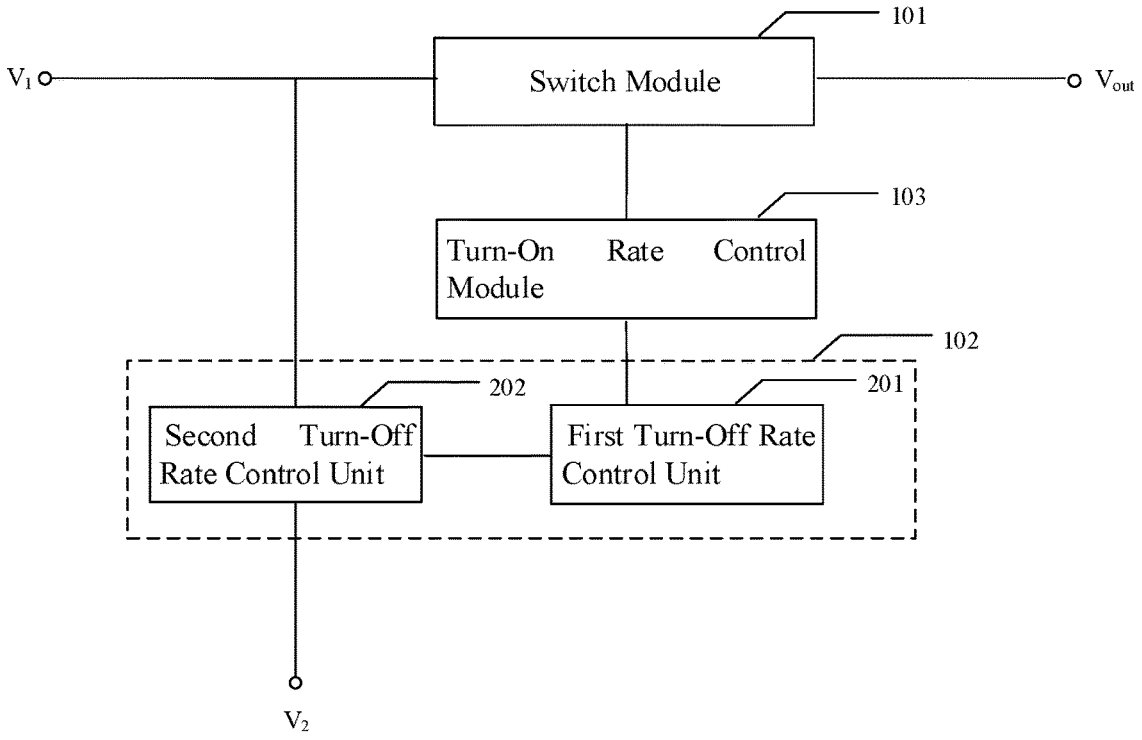
FIG. 4 shows a structure diagram of a circuit for regulating power supplying according to an exemplary arrangement of the present disclosure.

In an exemplary arrangement of the present disclosure, the circuit for regulating power supplying 100 further includes a turn-on rate control circuit 103, such as the structure diagram of the circuit for regulating power supplying shown in FIG. 4. The turn-on rate control circuit 103 is directly connected to the switch circuit 101 and the first turn-off rate control circuit 201, for controlling the turn-on rate of the switch circuit 101.

Figure 5:
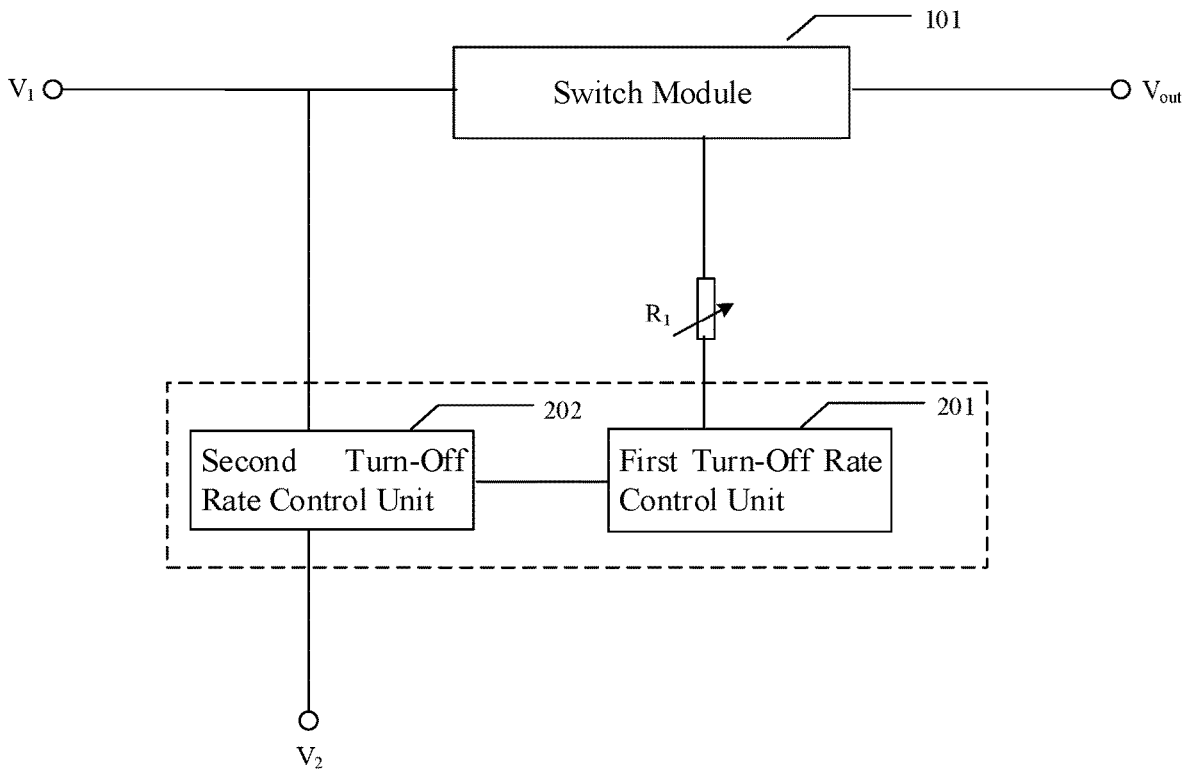
FIG. 5 shows a circuit diagram of a circuit for regulating power supplying according to an exemplary arrangement of the present disclosure.

Further, the turn-on rate control circuit 103 includes a first resistor $R_1$. FIG. 5 shows a circuit diagram of a circuit for regulating power supplying. As shown in FIG. 5, a first terminal of the first resistor $R_1$ is directly connected to the switch circuit 101, and a second terminal of the first resistor $R_1$ is directly connected to the turn-off rate control circuit 102. When the first power terminal $V_1$ is turned on, that is, when the first power terminal $V_1$ is connected with a signal, the first turn-off rate control sub-circuit 201 is in a turn-on state. A resistance value of the first resistor $R_1$ affects whether the switch circuit 101 is turned on or not, and the turn-on and turn-off of the switch circuit 101 controls the turning-on and turning-off of the power supply, and thus the turn-on rate of the switch circuit 101 can be controlled by adjusting the resistance value of the first resistor $R_1$, and the power-on rate is further controlled.

Figure 6:
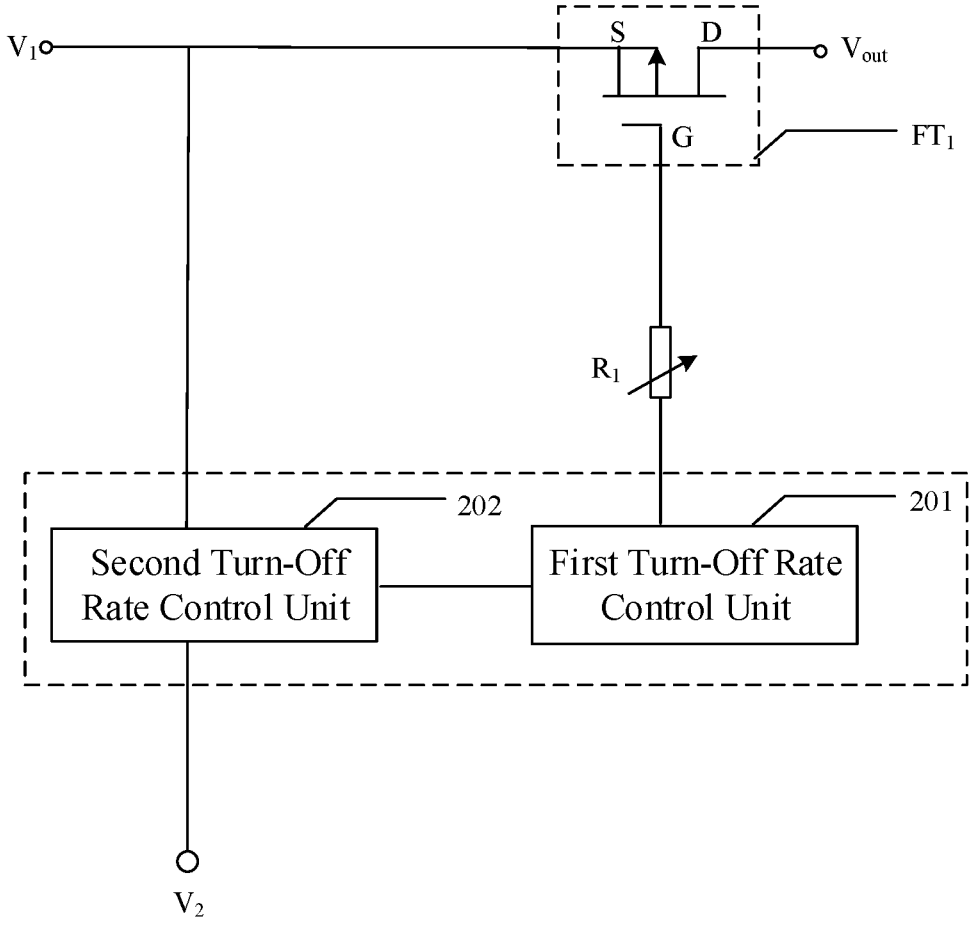
FIG. 6 shows a circuit diagram of a circuit for regulating power supplying according to an exemplary arrangement of the present disclosure.

In the exemplary arrangement of the present disclosure, the switch circuit 101 includes a switching transistor $FT_1$. The switching transistor $FT_1$ may be a P-type switching transistor or an N-type switching transistor, those skilled in the art may select a suitable doping type switching transistor according to actual needs. In the present disclosure, a structure of the circuit for regulating power supplying 100 is described by taking an N-type switching transistor as an example. FIG. 6 shows a circuit diagram of the circuit for regulating power supplying. As shown in FIG. 6, a source electrode S of the switching transistor $FT_1$ is connected to the first power terminal $V_1$, a drain electrode D is directly connected to an output terminal $V_{out}$ of the circuit for regulating power supplying, and a gate electrode G is directly connected to the first terminal of the first resistor $R_1$.

Figure 7:
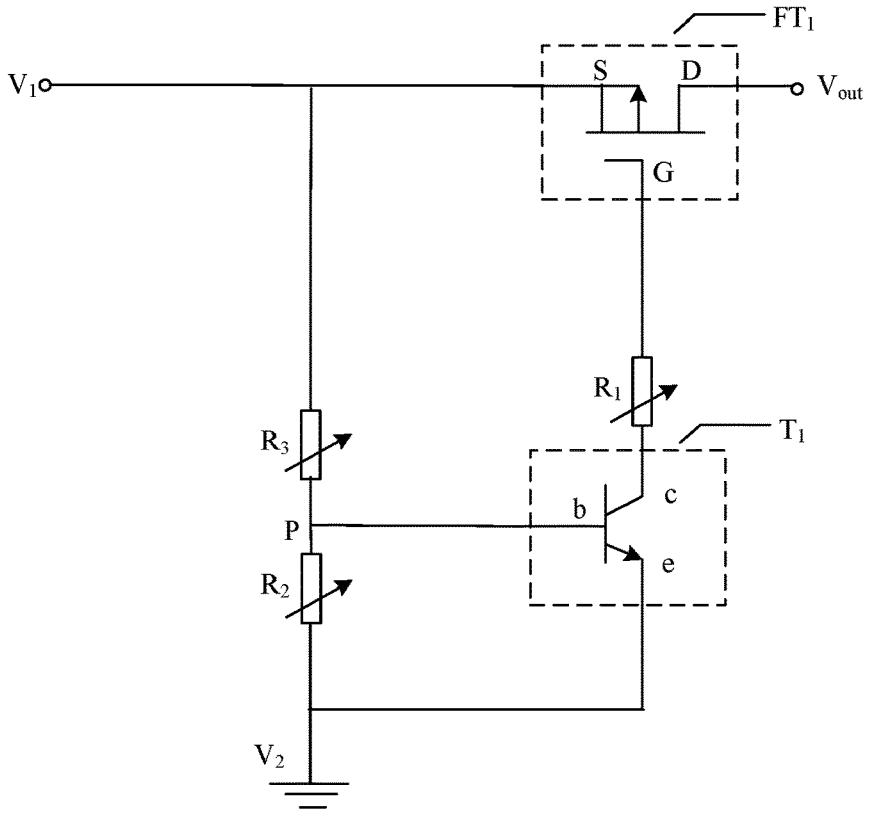
FIG. 7 shows a circuit diagram of a circuit for regulating power supplying according to an exemplary arrangement of the present disclosure.

In an exemplary arrangement of the present disclosure, the first turn-off rate control sub-circuit 201 includes a triode $T_1$. The triode $T_1$ may be a high-pass triode or a low-pass triode according to actual needs, and preferably the triode $T_1$ is a low-pass triode. The second turn-off rate control sub-circuit 202 includes a second resistor $R_2$ and a third resistor $R_3$. FIG. 7 shows a circuit diagram of a circuit for regulating power supplying. As shown in FIG. 7, a base of the triode $T_1$ is directly connected to a first terminal of the second resistor $R_2$ and is indirectly connected to the first power terminal $V_1$, a collector of the triode $T_1$ is directly connected to the second terminal of the first resistor $R_1$ and is indirectly connected to the gate electrode G of the switch circuit 101, and an emitter of the triode $T_1$ is directly connected to a second terminal of the second resistor $R_2$ and the second power terminal $V_2$; the second terminal of the second resistor $R_2$ is directly connected to the second power terminal $V_2$; a first terminal of the third resistor $R_3$ is directly connected to the first power terminal $V_1$, and a second terminal of the third resistor $R_3$ is directly connected to the first terminal of the second resistor $R_2$ and the base of the triode $T_1$.

The third resistor $R_3$ is used to ensure a voltage of the source electrode S of the switching transistor $FT_1$. At the same time, the third resistor $R_3$ and the second resistor $R_2$ are connected in series to divide the voltage. By adjusting resistance values of the third resistor $R_3$ and the second resistor $R_2$, a voltage drop at a point P between the third resistor $R_3$ and the second resistor $R_2$ is not changed. Since a potential at the point P is the same as that at the base of the triode $T_1$, a stability of the triode $T_1$ can be ensured by ensuring that the voltage drop at the point P is constant, and the turn-on rate of the switching transistor 101 can be controlled by adjusting the resistance of the first resistor $R_1$.

Figure 8:
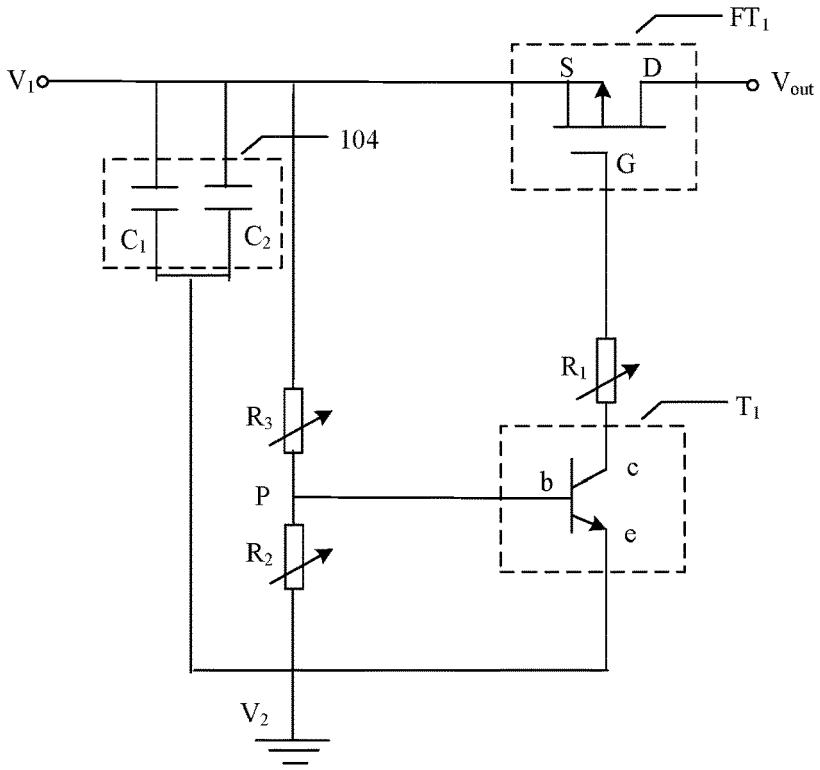
FIG. 8 shows a circuit diagram of a circuit for regulating power supplying according to an exemplary arrangement of the present disclosure.

In an exemplary arrangement of the present disclosure, the circuit for regulating power supplying 100 further includes a voltage supplying circuit 104 connected to the first power terminal $V_1$ and the second power terminal $V_2$, for storing a voltage provided by the first power terminal $V_1$. When signal supplying from the first power terminal $V_1$ is stopped, the voltage supplying circuit 104 provides a voltage, for example, to ensure a voltage required for power failure during the test of the display circuit. The voltage supplying circuit 104 includes a first capacitor $C_1$ and a second capacitor $C_2$. The first capacitor $C_1$ and the second capacitor $C_2$ are connected in parallel with each other. As shown in the circuit diagram of the circuit for regulating power supplying shown in FIG. 8, a first terminal of the first capacitor $C_1$ and a first terminal of the second capacitor $C_2$ are directly connected to the first power supply $V_1$, and a second terminal of the first capacitor $C_1$ and a second terminal of the second capacitor $C_2$ are directly connected to the second power supply $V_2$.

Figure 9:
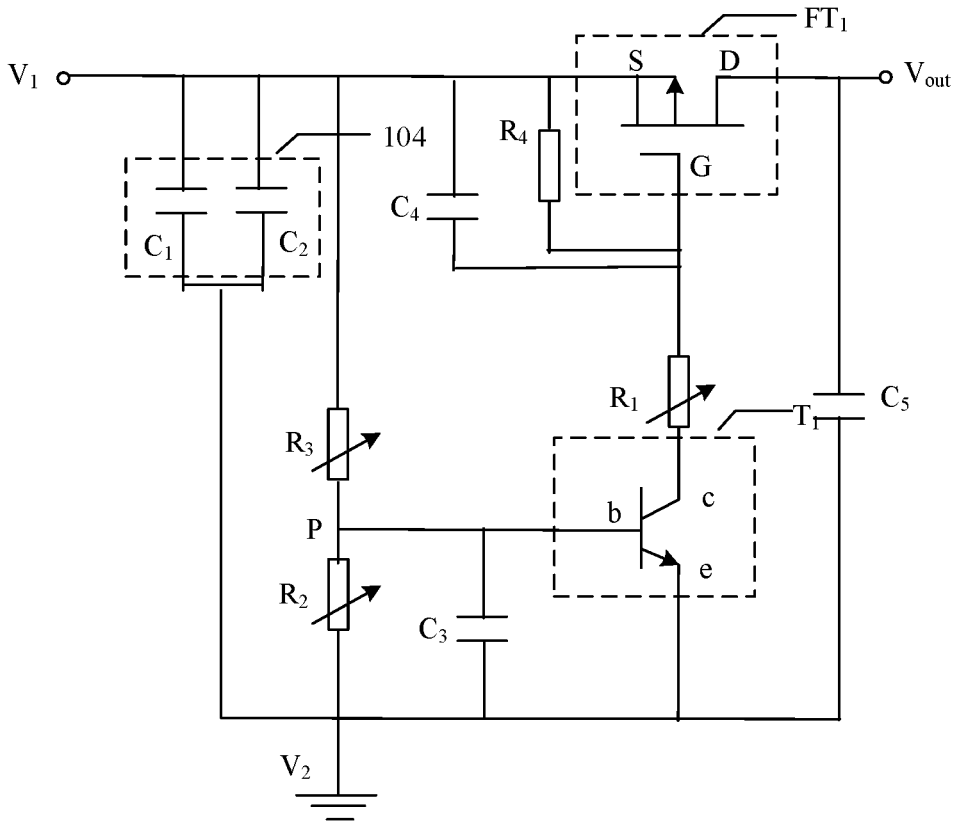
FIG. 9 shows a circuit diagram of a circuit for regulating power supplying according to an exemplary arrangement of the present disclosure.

In an exemplary arrangement of the present disclosure, the circuit for regulating power supplying 100 further includes a fourth resistor $R_4$, a third capacitor $C_3$, a fourth capacitor $C_4$ and a fifth capacitor $C_5$. As shown in FIG. 9, a first terminal of the fourth resistor $R_4$ is directly connected to the source electrode S of the switching transistor, and a second terminal of the fourth resistor $R_4$ is directly connected to the gate electrode G of the switching transistor; a first terminal of the third capacitor $C_3$ is directly connected to the base of the triode $T_1$, and a second terminal of the third capacitor $C_3$ is directly connected to the second power terminal $V_2$; a first terminal of the fourth capacitor $C_4$ is directly connected to the first power terminal $V_1$, and a second terminal of the fourth capacitor $C_4$ is directly connected to the gate electrode G of the switching transistor; a first terminal of the fifth capacitor $C_5$ is directly connected to the drain electrode D of the switching transistor, and a second terminal of the fifth capacitor $C_5$ is directly connected to the second power terminal $V_2$.

In an exemplary arrangement of the present disclosure, the first resistor $R_1$, the second resistor $R_2$ and the third resistor $R_3$ may be a programmable sliding rheostat; the fourth resistor $R_4$ may be a balancing resistor, which is used for dividing the voltage with the first resistor $R_1$ to adjust the voltage between the gate electrode G and the source electrode S of the switch circuit 101 when the first turn-off rate control sub-circuit 201 is turned on, and ensuring that the switch circuit 101 does not turn on when the first turn-off rate control sub-circuit 201 is not turned on; the third capacitor $C_3$ may be a bypass capacitor, the fourth capacitor $C_4$ may be a filter capacitor, and the fifth capacitor $C_5$ may be a decoupling capacitor.

Figure 10:
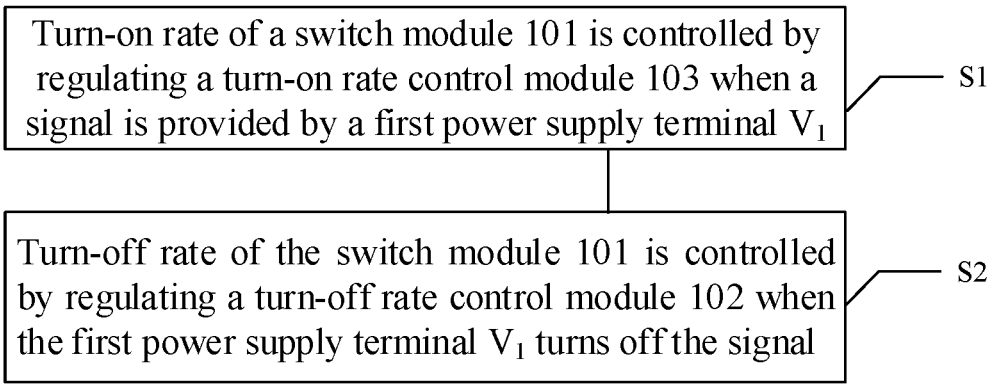
FIG. 10 shows a flowchart of a method for regulating a circuit power supply according to an exemplary arrangement of the present disclosure.

The present disclosure also provides a method for regulating a circuit power supply. As shown in FIG. 10, the method specifically includes the following blocks.

In S1, a turn-on rate of a switch circuit 101 is controlled by regulating a turn-on rate control circuit 103 when a signal is provided by a first power terminal $V_1$.

When a signal is provided to the circuit for regulating power supplying by the first power terminal $V_1$, a first turn-off rate control sub-circuit 201 is in a turn-on state, and a turn-on and turn-off of the power supply is controlled by on and off of the switch circuit 101. For example, a turn-on rate of the switch circuit 101 is controlled by regulating a resistance value of the turn-on rate control circuit 103 including a first resistor $R_1$, and a power-on rate is controlled when supplying power by the circuit for regulating power supplying 100.

Figure 11:
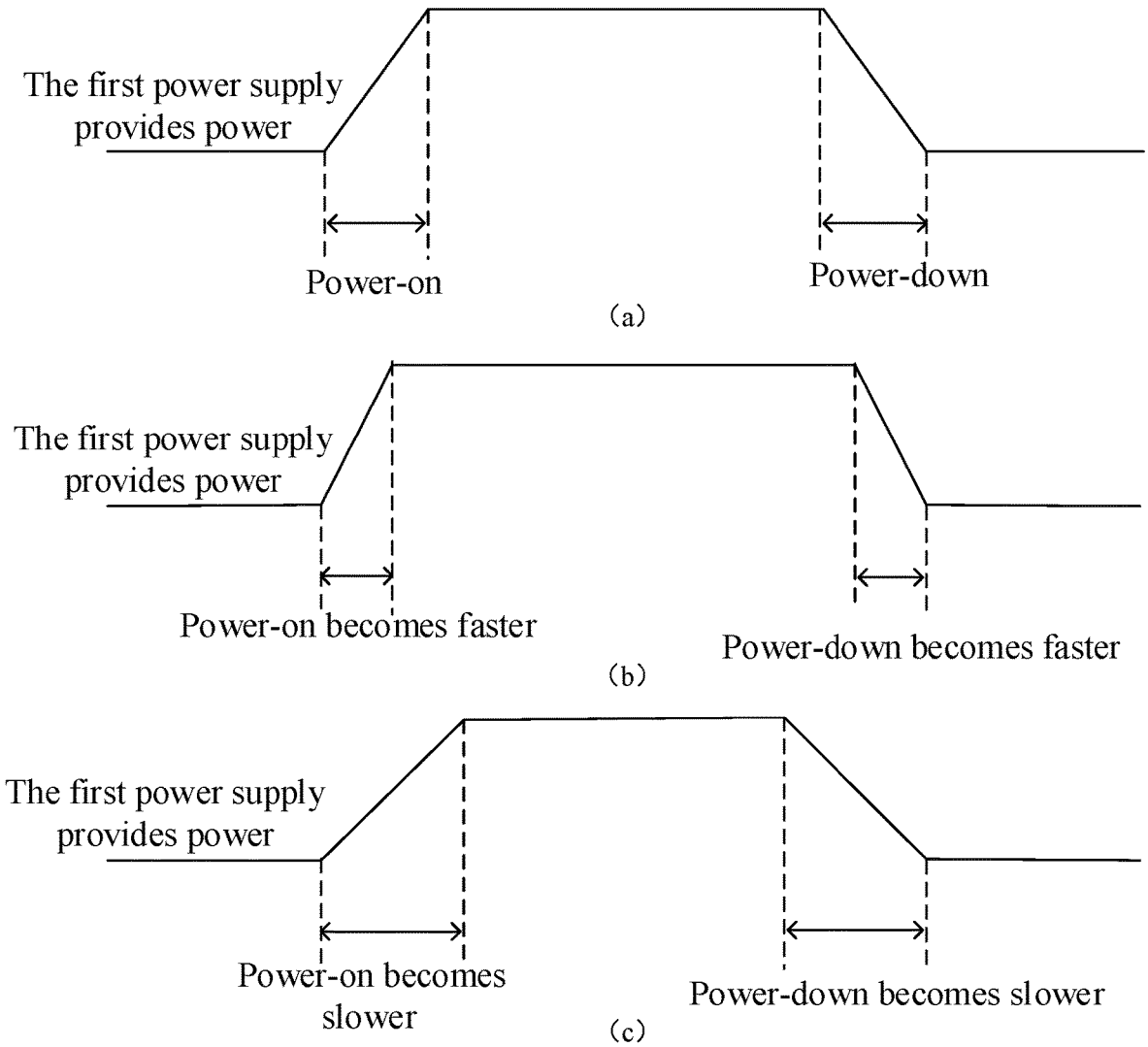
FIG. 11 shows a power-on or power-down timing diagram when a circuit for regulating power supplying supplies power or powers off according to an exemplary arrangement of the present disclosure.

FIG. 11 shows a power-on or power-down rate timing when the circuit for regulating power supplying provides power or power supplying is interrupted. When a resistance value of the first resistor $R_1$ remains unchanged, the turn-on rate of the switch circuit 101 is constant, and the power-on rate maintains a stable rate (as shown in FIG. 11(*a*)). If the resistance value of the first resistor $R_1$ is increased, the turn-on rate of the switch circuit 101 is decreased, so that the power-on rate of the circuit for regulating power supplying is slowed down when supplying power to the display circuit (as shown in FIG. 11(*c*)); and if the resistance value of the first resistor $R_1$ is reduced, the turn-on rate of the switch circuit 101 is increased, so that the power-on rate of the power supply rate regulation circuit becomes faster when supplying power to the display circuit (as shown in FIG. 11(*b*)).

In S2, a turn-off rate of the switch circuit 101 is controlled by regulating a turn-off rate control circuit 102 when the first power terminal $V_1$ turns off the signal.

When the first power terminal $V_1$ stops providing a signal to the circuit for regulating power supplying, the resistance value of the first resistor $R_1$ is fixed, the turn-off rate of the first turn-off rate control sub-circuit 201 determines the turn-off rate of the switch circuit 101, and at the same time, the turn-off rate of the first turn-off rate control sub-circuit 201 is controlled by regulating the size of a second turn-off rate control sub-circuit 202.

Since a second resistor $R_2$ is divided to a ground, when the resistance value of the second resistor $R_2$ remains unchanged, the turn-off rate of the switch circuit 101 is constant, and the power-down rate remains a stable rate (as shown in FIG. 11(*a*)); when the resistance value of the second resistor $R_2$ is increased, the turn-off rate of the switch circuit 101 is increased, so that the power-down rate is increased when the circuit for regulating power supplying powers off the display circuit (as shown in FIG. 11(*b*)); when the resistance value of the second resistor $R_2$ is decreased, the turn-off rate of the switch circuit 101 is decreased, so that the power-down rate is slowed down when the power supply rate regulation circuit powers off the display circuit (as shown in FIG. 11(*c*)).

Figure 12:
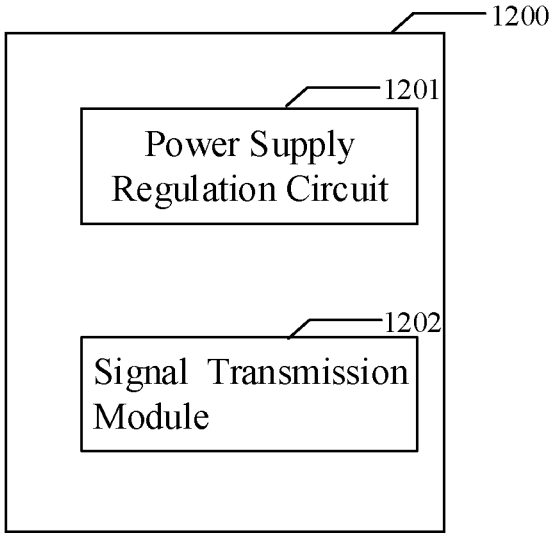
FIG. 12 shows a structure diagram of a test system according to an exemplary arrangement of the present disclosure.

The present disclosure further provides a test system. As shown in FIG. 12, the test system 1200 includes a circuit for regulating power supplying 1201 and a signal transmission circuit 1202. The power supply rate regulation circuit 1201 is the circuit for regulating power supplying in the present disclosure, and is used to control the rate of power supplying and disconnecting to the display circuit. The signal transmission circuit 1202 is used to transmit signals to the display circuit.

Figure 13:
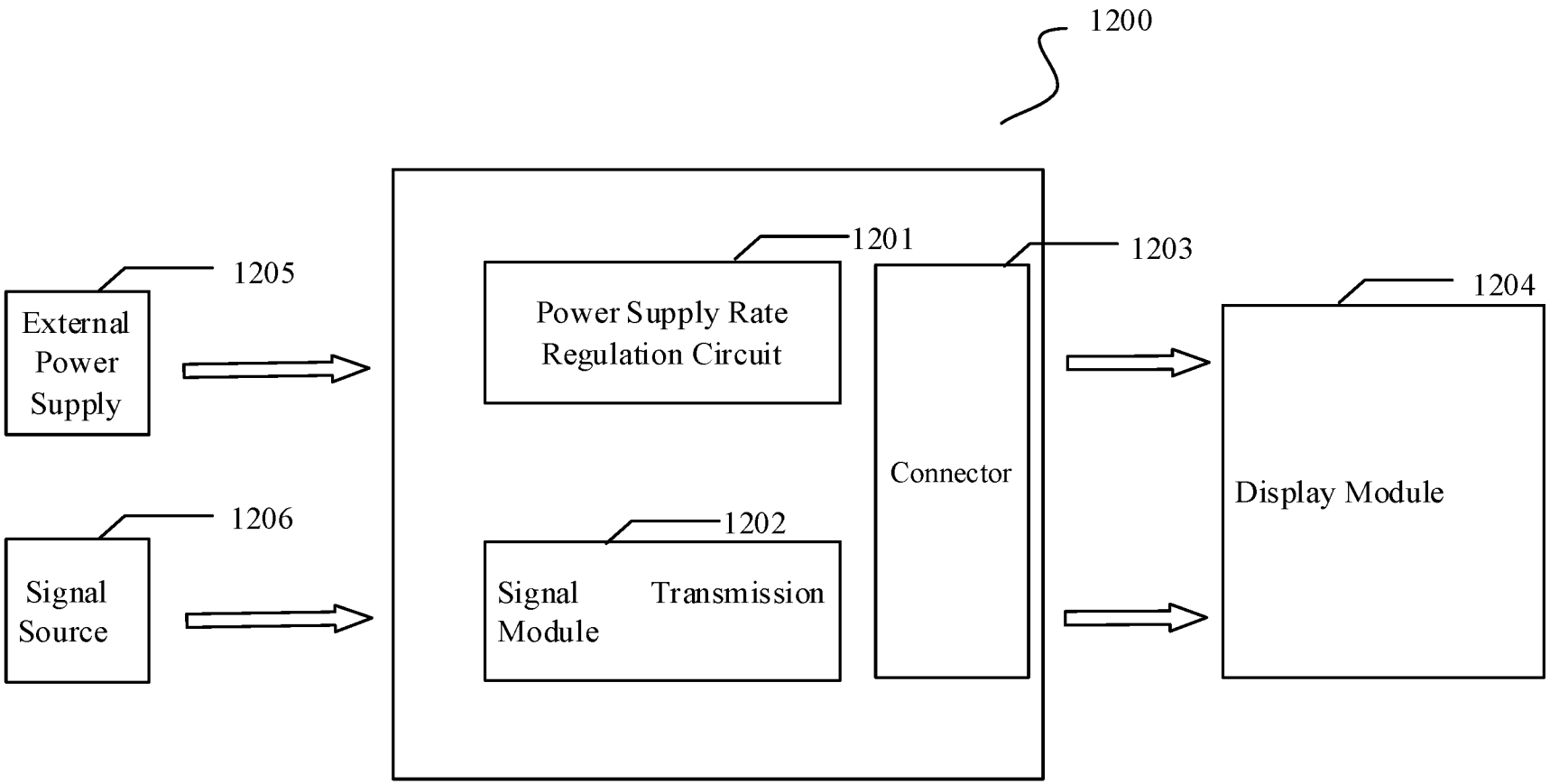
FIG. 13 shows a structure diagram of a test system according to an exemplary arrangement of the present disclosure.

Further, as shown in FIG. 13, the test system in the present disclosure further includes a connector 1203 configured to connect the circuit for regulating power supplying 1201 and the signal transmission circuit 1202 to the display circuit 1204. In addition, a liquid crystal display circuit test system 1200 further includes an external power supply 1205 and a signal source 1206. The external power supply 1205 is configured to supply voltage signals to the circuit for regulating power supplying, and the signal source 1206 is configured to input signals to the signal transmission circuit 1202.

The display circuit 1204 may be a liquid crystal display circuit, a light emitting diode (LED) display circuit, an organic light emitting diode (OLED) display circuit, or other display circuits commonly used in the field. Preferably, the display circuit 1204 is the liquid crystal display circuit. The signal source 1206 may be an embedded display interface (eDP) signal source, and may be other signal sources commonly used in the field, which is not specifically limited in the present disclosure.

The present disclosure can realize the regulation of the power-on and power-down rate of the display circuit through the circuit for regulating power supplying, and can truly simulate the power-on and power-down speed state of the power supply, and thus a guarantee for the reliability of the test of the display circuit is provided.

Other arrangements of the present disclosure will be apparent to those skilled in the art from consideration of the specification and practice of the disclosures herein. This application is intended to cover any variations, uses, or adaptations of the disclosure following the general principles thereof and including such departures from the present disclosure as come within known or customary practice in the art. It is intended that the specification and examples be considered as exemplary only, with a true scope and spirit of the present disclosure being indicated by the following claims.

It will be appreciated that the inventive concept is not limited to the exact construction that has been described above and illustrated in the accompanying drawings, and that various modifications and changes can be made without departing from the scope thereof. It is intended that the scope of the present disclosure only be limited by the appended claims.

What is claimed is:

1. A circuit for regulating power supplying, comprising:

a switch circuit connected to a first power terminal and an output terminal, and configured to control on or off of power supplying; and a turn-off rate control circuit connected to the first power terminal, a second power terminal and the switch circuit, and configured to control a turn-off rate of the switch circuit, the turn-off rate control circuit comprising:

a first turn-off rate control sub-circuit connected to the switch circuit, the first power terminal and the second power terminal, and configured to control the turn-off rate of the switch circuit, the first turn-off rate control sub-circuit comprising a triode, wherein a first terminal of the triode is connected to the switch circuit, a second terminal of the triode is connected to the second power terminal, and a control terminal of the triode is connected to the first power terminal; and a second turn-off rate control sub-circuit connected to the first turn-off rate control sub-circuit and the second power terminal, and configured to provide a turn-on voltage to the first turn-off rate control sub-circuit, the second turn-off rate control sub-circuit comprising a second resistor and a third resistor, wherein a first terminal of the second resistor is connected to the control terminal of the triode, and a second terminal of the second resistor is connected to the second power terminal; a first terminal of the third resistor is connected to the first power terminal, and a second terminal of the third resistor is connected to the first terminal of the second resistor.

2. The circuit according to claim 1, further comprising:

a turn-on rate control circuit connected to the switch circuit and the turn-off rate control circuit, and configured to control a turn-on rate of the switch circuit.

3. The circuit according to claim 2, wherein the turn-on rate control circuit comprises a first resistor, wherein a first terminal of the first resistor is connected to the switch circuit, and a second terminal of the first resistor is connected to the turn-off rate control circuit.

4. The circuit according to claim 1, wherein the switch circuit comprises a switching transistor, wherein a first terminal of the switching transistor is connected to the first power terminal, a second terminal of the switching transistor is connected to the output terminal, and a control terminal of the switching transistor is connected to the turn-off rate control circuit.

5. The circuit according to claim 1, further comprising:

a voltage supplying circuit connected to the first power terminal and the second power terminal, and configured to store a voltage provided by the first power terminal.

6. The circuit according to claim 5, wherein the voltage supplying circuit comprises a first capacitor and a second capacitor, wherein a first terminal of the first capacitor and a first terminal of the second capacitor are connected to the first power terminal, and a second terminal of the first capacitor and a second terminal of the second capacitor are connected to the second power terminal.

7. The circuit according to claim 1, further comprising a turn-on rate control circuit and a voltage supplying circuit, the switch circuit comprises a switching transistor, the turn-on rate control circuit comprises a first resistor, and the voltage supplying circuit comprises a first capacitor and a second capacitor, wherein a first terminal of the switching transistor is connected to the first power terminal, a second terminal of the switching transistor is connected to the output terminal, and a control terminal of the switching transistor is connected to a first terminal of the first resistor;

the first terminal of the triode is connected to a second terminal of the first resistor, and the control terminal of the triode is connected to the second terminal of the third resistor;

a first terminal of the first capacitor and a first terminal of the second capacitor are connected to the first power terminal, and a second terminal of the first capacitor and a second terminal of the second capacitor are connected to the second power terminal.

8. The circuit according to claim 7, further comprising a fourth resistor, a third capacitor, a fourth capacitor and a fifth capacitor, wherein a first terminal of the fourth resistor is connected to the first terminal of the switching transistor, and a second terminal of the fourth resistor is connected to the control terminal of the switching transistor;

a first terminal of the third capacitor is connected to the control terminal of the triode, and a second terminal of the third capacitor is connected to the second power terminal;

a first terminal of the fourth capacitor is connected to the first power terminal, and a second terminal of the fourth capacitor is connected to the control terminal of the switching transistor; and a first terminal of the fifth capacitor is connected to the second terminal of the switching transistor, and a second terminal of the fifth capacitor is connected to the second power terminal.

9. The circuit according to claim 1, wherein a potential of the first power terminal is higher than a potential of the second power terminal.

10. A test system, comprising:

the circuit for regulating power supplying according to claim 1; and a signal transmission circuit configured to transmit a signal to a display circuit.

11. A method for regulating supplying of power by using a circuit for regulating supplying of power, wherein the circuit comprises:

a switch circuit connected to a first power terminal and an output terminal, and configured to control on or off of power supplying; and a turn-off rate control circuit connected to the first power terminal, a second power terminal and the switch circuit, and configured to control a turn-off rate of the switch circuit the turn-off rate control circuit comprising:

a first turn-off rate control sub-circuit connected to the switch circuit, the first power terminal and the second power terminal, and configured to control the turn-off rate of the switch circuit, the first turn-off rate control sub-circuit comprising a triode, wherein a first terminal of the triode is connected to the switch circuit, a second terminal of the triode is connected to the second power terminal, and a control terminal of the triode is connected to the first power terminal; and a second turn-off rate control sub-circuit connected to the first turn-off rate control sub-circuit and the second power terminal, and configured to provide a turn-on voltage to the first turn-off rate control sub-circuit, the second turn-off rate control sub-circuit comprising a second resistor and a third resistor, wherein a first terminal of the second resistor is connected to the control terminal of the triode, and a second terminal of the second resistor is connected to the second power terminal; a first terminal of the third resistor is connected to the first power terminal, and a second terminal of the third resistor is connected to the first terminal of the second resistor, wherein the method comprises:

controlling the turn-off rate of the switch circuit by regulating the turn-off rate control circuit when supplying of a power signal from the first power terminal is stopped.

12. The method according to claim 11, wherein the method further comprises:

controlling a turn-on rate of the switch circuit by regulating a turn-on rate control circuit when the power signal is provided by the first power terminal.

13. The method according to claim 12, wherein the controlling the turn-on rate of the switch circuit by regulating the turn-on rate control circuit when a signal is provided by the first power terminal comprises:

increasing a resistance value of a first resistor to reduce the turn-on rate of the switch circuit; or reducing the resistance value of the first resistor to increase the turn-on rate of the switch circuit.

14. The method according to claim 11, wherein the controlling the turn-off rate of the switch circuit by regulating the turn-off rate control circuit when the signal is disconnected by the first power terminal comprises:

increasing a resistance value of a turn-off rate control sub-circuit to increase the turn-off rate of the switch circuit; or reducing the resistance value of the turn-off rate control sub-circuit to reduce the turn-off rate of the switch circuit.

* * * * *